US009279390B2

(12) United States Patent
Learman et al.

(10) Patent No.: US 9,279,390 B2
(45) Date of Patent: Mar. 8, 2016

(54) ACCELERATOR DEVICE FOR A CARBURETOR

(71) Applicant: WALBRO ENGINE MANAGEMENT, L.L.C., Tucson, AZ (US)

(72) Inventors: Paul S. Learman, Bad Axe, MI (US); Larry D. Whittaker, Cass City, MI (US)

(73) Assignee: WALBRO ENGINE MANAGEMENT, L.L.C., Tucson, AZ (US)

( * ) Notice: Subject to any disclaimer, the term of this patent is extended or adjusted under 35 U.S.C. 154(b) by 191 days.

(21) Appl. No.: 14/230,687

(22) Filed: Mar. 31, 2014

(65) Prior Publication Data

US 2014/0306358 A1 Oct. 16, 2014

Related U.S. Application Data

(60) Provisional application No. 61/812,053, filed on Apr. 15, 2013.

(51) Int. Cl.

| | |
|---|---|
| ***F02M 7/08*** | (2006.01) |
| ***B01F 3/04*** | (2006.01) |
| ***F02M 19/02*** | (2006.01) |
| *F02M 17/04* | (2006.01) |

(52) U.S. Cl.

CPC ..... *F02M 19/021* (2013.01); *B01F 3/04* (2013.01); *F02M 7/08* (2013.01); *F02M 7/083* (2013.01); *F02M 17/04* (2013.01)

(58) Field of Classification Search

CPC ..... F02M 7/08; B01F 3/04
USPC ..... 261/34.2, 35, 51
See application file for complete search history.

(56) References Cited

U.S. PATENT DOCUMENTS

| | | | |
|---|---|---|---|
| 5,250,233 | A | 10/1993 | Swanson |
| 5,611,312 | A | 3/1997 | Swanson et al. |
| 6,293,524 | B1 | 9/2001 | Endo et al. |
| 7,717,403 | B2 | 5/2010 | Zbytowski et al. |

*Primary Examiner* — Robert A Hopkins
(74) *Attorney, Agent, or Firm* — Reising Ethington P.C.

(57) ABSTRACT

In at least one implementation a carburetor includes an intake bore with a port opening into the intake bore, a fuel chamber from which fuel is supplied to the intake bore, and an accelerator device including a fuel reservoir. A fuel flow control valve is provided between the fuel chamber and the port to control the flow rate of fuel to the port and at least one passage communicates the fuel reservoir with the port and fuel in the fuel reservoir is supplied to the port therethrough. The passage also communicates the fuel reservoir with the fuel chamber. The fuel flow control valve is located between the fuel reservoir and the port and between the fuel chamber and the port, and the passage includes a portion extending between the fuel reservoir and the fuel chamber independently of the fuel flow control valve.

12 Claims, 4 Drawing Sheets

ACCELERATOR DEVICE FOR A CARBURETOR

REFERENCE TO CO-PENDING APPLICATION

This application claims the benefit of U.S. Provisional Application No. 61/812,053 filed Apr. 15, 2013, which is incorporated herein by reference in its entirety.

TECHNICAL FIELD

The present disclosure relates generally to carburetors and more particularly to a carburetor with an accelerator.

BACKGROUND

Some small internal combustion engines for handheld power tools such as chain saws, grass trimmers, weed trimmers, leaf blowers, and the like have carburetors with an internal accelerator pump which supplies additional fuel to the operating engine in certain operating conditions. The accelerator device can temporarily increase the amount of fuel delivered to the engine when the throttle valve is opened fully for improving the acceleration of the engine. This additional fuel is needed to smoothly and rapidly accelerate the engine without stumbling, particularly when the engine is under a load.

SUMMARY

In at least one implementation a carburetor includes an intake bore with a port opening into the intake bore, a fuel chamber from which fuel is supplied within the carburetor to the intake bore through the port, and an accelerator device for increasing an amount of fuel supplied to the port under at least certain operating conditions and including a fuel reservoir constructed and arranged to store fuel. A fuel flow control valve is provided between the fuel chamber and the port to control the flow rate of fuel to the port and at least one passage communicates the fuel reservoir with the port and fuel in the fuel reservoir is supplied to the port therethrough. The passage also communicates the fuel reservoir with the fuel chamber. The fuel flow control valve is located between the fuel reservoir and the port and between the fuel chamber and the port, and the passage includes a portion extending between the fuel reservoir and the fuel chamber independently of the fuel flow control valve.

In at least some implementations, a carburetor includes an intake bore, a fuel chamber, an accelerator device, at least one fuel flow control valve and at least one passage. The intake bore includes a low speed port opening into the intake bore and a high speed port opening into the intake bore. Fuel is supplied from the fuel chamber to the intake bore through both the low speed port and the high speed port. The accelerator device increases an amount of fuel supplied to the intake bore through one or both of the low speed port and the high speed port under at least certain operating conditions and includes a fuel reservoir constructed and arranged to store fuel. At least one fuel flow control valve is located between the fuel chamber and both the low speed port and the high speed port to control the flow rate of fuel to the low speed port and the high speed port. And at least one passage communicates the fuel reservoir with the low speed port and with the high speed port and through which fuel in the fuel reservoir is supplied to the ports. The passage also communicates the fuel reservoir with the fuel chamber. At least one fuel flow control valve is located between the fuel reservoir and both the high speed port and the low speed port, and between the fuel chamber and both the low speed port and the high speed port, and at least one passage includes a portion extending between the fuel reservoir and the fuel chamber independently of a fuel flow control valve.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
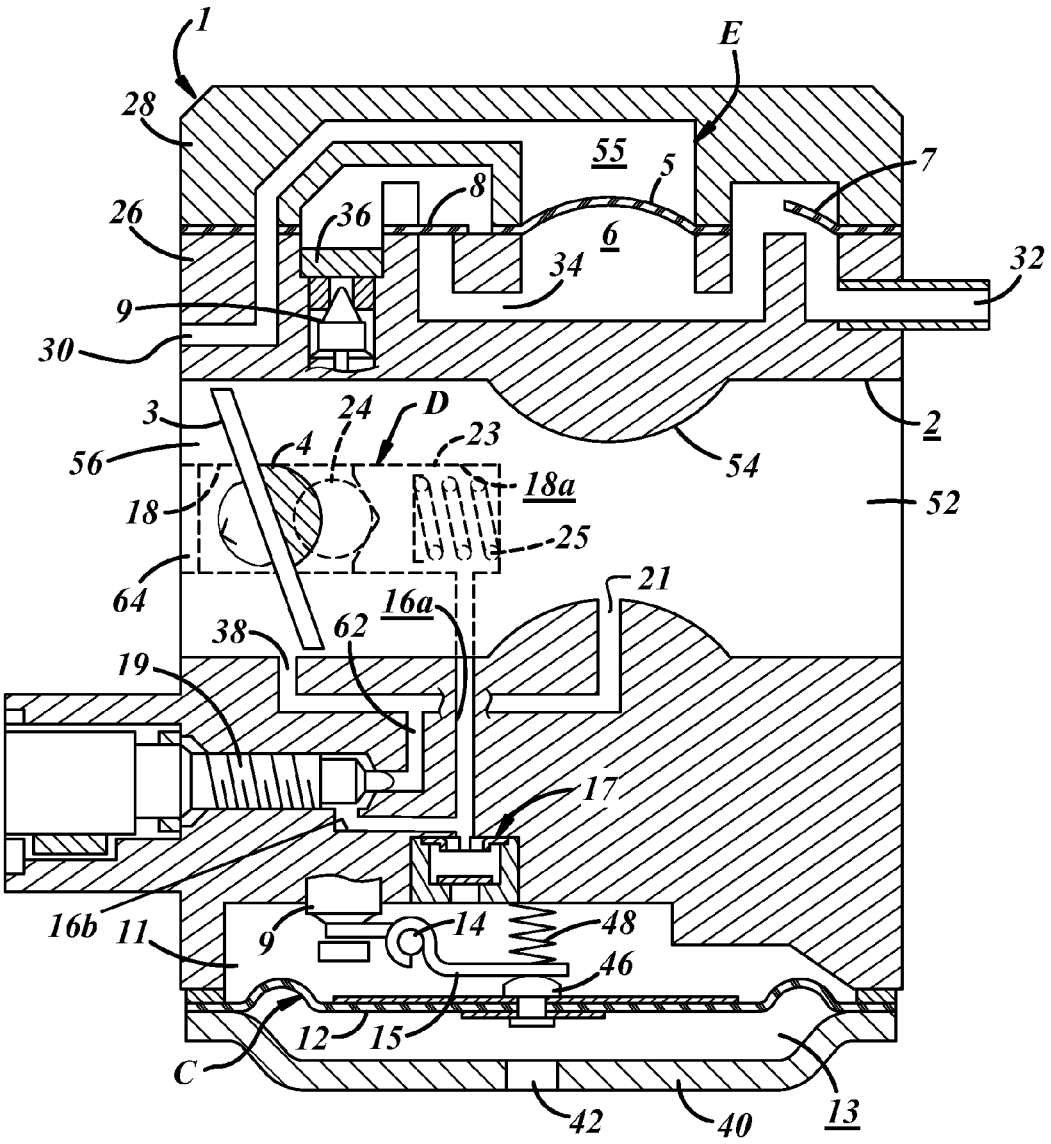
FIG. 1 is a sectional view of one embodiment of a carburetor with a single fuel flow control valve and an accelerator.

Referring in more detail to the drawings, FIG. 1 illustrates one embodiment of a diaphragm type carburetor 1 for an internal combustion gasoline fueled engine with an accelerator device or pump D. The carburetor 1 may be used, for example, in a small general-purpose internal combustion engine. The diaphragm carburetor 1 also has a fuel supply pump assembly E and a fuel metering system C, each of which, if desired, may be of conventional construction. In one embodiment, the carburetor 1 may be a butterfly valve type carburetor.

When the engine is operating, the fuel pump assembly E supplies fuel to the metering system C of the carburetor 1. The fuel pump assembly E has a flexible diaphragm or membrane 5 received and sealed between an upper face of the carburetor body 26 and a lower face of an upper cover 28 and defining in part a fuel pump chamber 6 and a pressure pulse chamber 55 to which pressure and vacuum pulses in the crankcase of an operating engine are introduced through a passage 30 to flex or actuate the diaphragm 5. The fuel pump chamber 6 communicates with an external fuel tank (not shown) via an inlet passage 32 formed in the carburetor main body and a one-way check valve 7 and a reciprocating movement of the diaphragm 5 caused by the pulsating pressure draws fuel from the fuel tank and feeds it into the pump chamber 6. The movement of the diaphragm 5 draws the fuel through inlet passage 32 and one-way check valve 7 into the pump chamber 6 and supplies the fuel under pressure through an outlet passage 34, one-way check valve 8, and a screen 36, to the fuel metering system C through a flow control valve 9. A fuel-intake movement of the pump diaphragm 5 causes the check valve 8 to close and the check valve 7 to open and to thereby allow fuel to be drawn from the fuel tank. A fuel expelling movement of the pump diaphragm 5 causes the check valve 8 to open, the check valve 7 to close and forces the fuel from the fuel tank into a fuel metering chamber 11 of the fuel metering system C through which fuel is supplied within the carburetor.

The fuel metering system C has a flexible diaphragm or membrane 12 received and sealed between a lower face of the carburetor body 26 and a lower cover 40. The diaphragm 12 defines on one side the fuel metering chamber 11 and on the other side an atmospheric air chamber 13. The atmospheric air chamber 13 communicates with the atmosphere exteriorly of the carburetor through a port 42 in the lower cover 40. The flow valve 9 is opened and closed to control the admission of fuel to chamber 11 by movement of the diaphragm 12 which is operably connected to the valve 9 by a lever 15. At one end, the lever 15 is connected to the flow valve 9, and at the other end the lever 15 bears on a projection 46 attached to the center of the diaphragm 12. The lever 15 is rotatably supported by a pivot shaft 14 and yieldably biased by a spring 48 bearing on the lever 15 to bias the valve 9 to its closed position. In one embodiment, the lever 15 is resiliently urged in the direction to abut an end of the lever 15 against projection 46.

When the pressure of the atmospheric chamber 13 is higher than the pressure of the fuel metering chamber 11 to such an extent that the diaphragm 12 is displaced in a direction reducing the volume of the fuel metering chamber 11, the projection 46 pushes on and moves the lever 15 about its pivot 14, and the resulting counter clockwise rotation of the lever 15 opens the fuel feed control valve 9. Fuel then flows into the fuel metering chamber 11.

The carburetor 1 has an intake bore or air and fuel mixing passage 2 with an air inlet 52, a restricted venturi section 54 downstream of the inlet, and an outlet 56 downstream of the venturi 54 which communicates with the engine. A throttle valve head 3 is received in the intake bore 2 downstream of the venturi 54 and is mounted on a throttle valve shaft 4 extending transversely through the bore and journalled for rotation in the carburetor body 26.

In operation of the carburetor 1, fuel is supplied from the metering chamber 11 to a main fuel nozzle 21 opening into the intake bore 2 via a check valve 17, a first fuel passage 16*a*, a fuel reservoir chamber 18*a*, a second fuel passage 16*b*, and a fuel flow control valve (e.g. a fuel metering needle valve) 19. A check valve (not shown in this embodiment but shown in FIG. 2) may be provided at or near the main fuel nozzle 21, if desired. Fuel is also supplied from the metering chamber 11 to one or more low speed fuel nozzles or ports 38 which may open into the intake bore 2 both upstream and downstream of the throttle valve 3 in its idle or closed position, via the second fuel passage 16*b*, and the fuel flow control valve 19. That is, a single flow control valve 19 may be used and the passage 16*b* may lead to both the low speed port(s) 38 and the main fuel nozzle or port 21. Of course, other arrangements are possible, a couple of which will be described with regard to the other figures.

In operation, air flowing through the intake bore 2 creates a pressure differential causing fuel to flow through the low speed nozzle 38 downstream of the throttle valve 3 (in its idle position) into the intake bore 2 and in the engine under idle and near idle operating conditions, and to flow through the main fuel nozzle 21 into the intake bore 2 and the engine when the engine is in the range from near idle to wide open throttle operating conditions. This pressure differential acts on the diaphragm 12 to open and close the valve 9 to maintain a predetermined quantity of fuel in the metering chamber 11 and at a substantially constant pressure when the engine is operating to supply fuel to the low speed nozzle 38 and the main fuel nozzle 21.

As shown in FIG. 1, in one embodiment the accelerator device or pump D is provided inside the carburetor body 26 adjacent the throttle shaft 4 in an area spaced or remote from or outside of the intake bore 2. The accelerator pump D may increase the amount of fuel discharged from the main fuel nozzle 21 and into the intake bore 2 when opening the throttle valve 3. The accelerator pump D may include a piston 23 axially slideably received in a cylindrical chamber 18 and a cam that may be carried by or formed in the throttle valve shaft 4. In one embodiment the piston 23 may be a short, cylindrically shaped piston. In one embodiment, the other end of the cylindrical chamber 18 is closed by a plug 64 press fit therein. The fuel reservoir chamber 18*a* is defined by the cylindrical chamber 18 and an end of the piston 23. The fuel reservoir chamber 18*a* is configured to store fuel and communicates with both the fuel metering chamber 11 and the main fuel nozzle 21 and/or low speed ports 38 (shown here as an open port without any separate jet or valve therein). The accelerator pump D draws fuel into the fuel reservoir chamber 18*a* when closing the valve 3 and expels fuel out of the fuel reservoir chamber 18*a* when opening the valve 3, in synchronism with a valve opening and closing movement of the valve shaft 4.

The first fuel passage 16*a* communicates with the reservoir chamber 18*a* and the fuel metering chamber 11 through a check valve 17. The check valve 17 may comprise a disk-shaped valve member that is configured to selectively close the first fuel passage 16*a* facing the fuel metering chamber 11 under gravitational force and to be lifted by the force of the flow of fuel, and comprises a retainer that limits the opening movement of the valve member and has a cutout or holes to permit the flow of fuel through the retainer even when the valve member is engaged with the retainer.

The first fuel passage 16*a* also communicates with the second fuel passage 16*b* downstream of the check valve 17. As noted above, the second fuel passage 16*b* leads to ports 21 and 38 with needle valve 19 disposed upstream of the ports 21, 38 and downstream of the check valve 17.

The throttle valve shaft 4 extends across a part of the cylinder chamber 18 that is located on the opposite side of the fuel reservoir 18*a* with respect to the piston 23. A ball 24 is disposed in the cylinder chamber 18 and between the valve shaft 4 and the piston 23. In this implementation, the piston 23 is actuated by a cam 4*a* that is connected to, carried by or actuated by the valve shaft 4 and engages the ball 24 disposed between them and received in a recess in an end of the piston 23. The valve shaft 4 may include a portion with a D-shaped cross section defining at least part of the cam 4*a* in this implementation. The cam 4*a* displaces the piston 23 in synchronism with a valve opening and closing movement of the valve shaft 4. Of course, the accelerator pump D could be of a different construction and arrangement, and need not use any ball, and need not be actuated by the throttle valve shaft.

In one embodiment, a seal may be provided between the piston 23 and the bore 18 by an O-ring (not shown) and the piston 23 is yieldably biased towards its retracted position and into engagement with the ball 24 which in turn is urged into engagement with the cam 4*a* by a spring 25 received in the reservoir 18*a* and bearing on the piston 23.

When the valve shaft 4 is turned to open the throttle valve, the ball 24 is displaced toward the piston 23 so that the piston 23 is displaced to reduce the volume of the fuel reservoir 18*a*. The amount of the fuel corresponding to the reduction in the volume of the reservoir 18*a* is moved into the first fuel passage 16*a*. Because the first fuel passage 16*a* has the check valve 17, the fuel that is pushed out from the fuel reservoir 18*a* is directed to the second fuel passage 16*b*, and discharged into the intake bore 2 via the main fuel nozzle 21 and/or low speed ports 38. Therefore, the amount of fuel discharged from the carburetor can be increased at the time of opening the throttle valve which may be useful to support acceleration of the engine.

When the valve shaft 4 is turned in the direction closing the throttle valve, the spring 25 keeps the piston 23 engaged with the ball 24 and the ball 24 engaged with the throttle valve shaft 4 and thereby returns the piston 23 to its start position and increases the volume of the fuel reservoir chamber 18*a*. The fuel reservoir chamber thereby takes in fuel from the first fuel passage 16*a*. In at least some implementations, the first fuel passage is located upstream of the needle valve 19 and the ports 21, 38 are downstream of the needle valve and far enough away from the reservoir chamber that air is not drawn into the reservoir chamber through the ports 21, 38 and passages 16*a*, 16*b*. Accordingly, the fuel reservoir chamber 18*a* can be refilled with liquid fuel that may be ejected therefrom during the next acceleration cycle.

Refilling the fuel reservoir chamber 18*a* may temporarily lean out the fuel and air mixture delivered to the engine which may be desirable in at least certain engines to avoid a rich comedown condition wherein a richer than needed fuel and air mixture is delivered to the engine when the engine decelerates toward engine idle operation. Accordingly, the accelerator pump D can improve acceleration and comedown of an engine.

Figure 2:
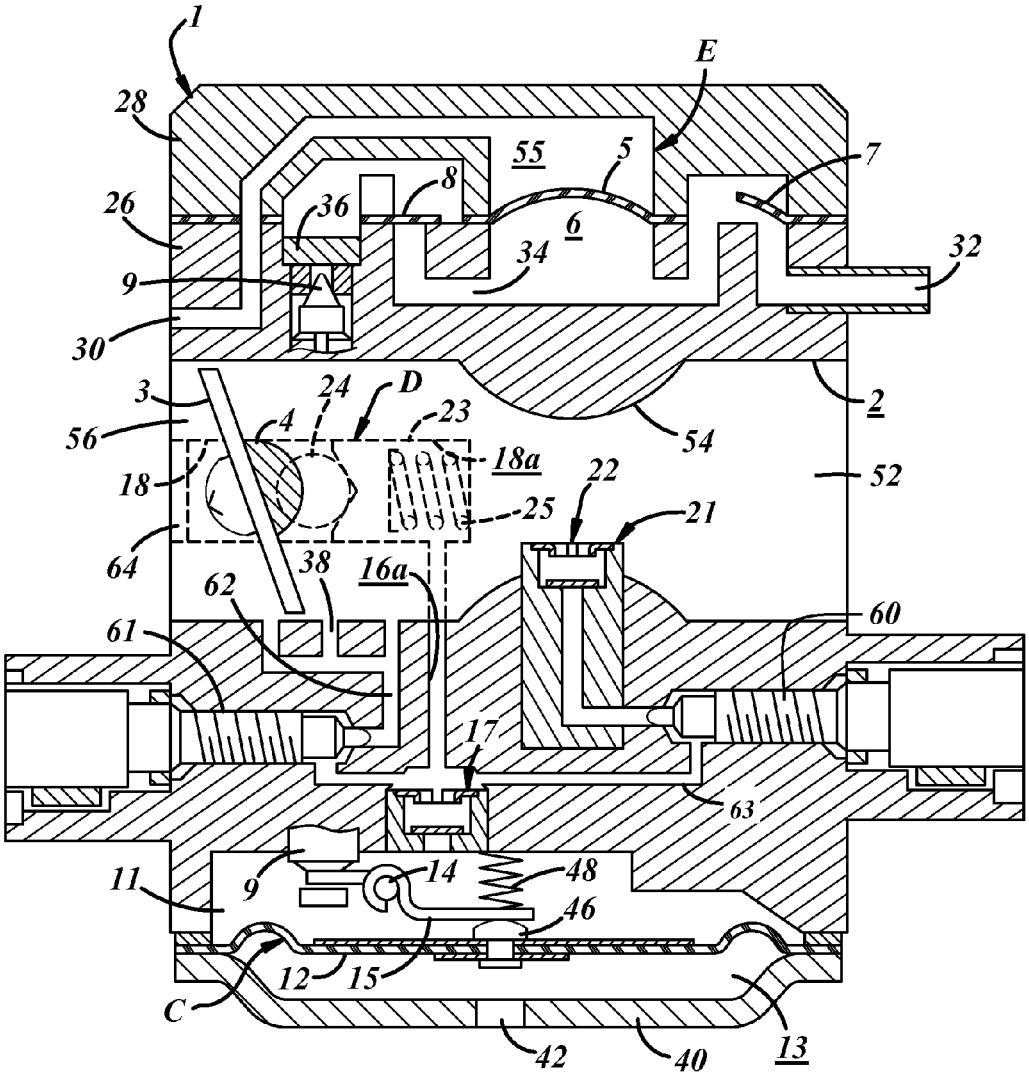
FIG. 2 is a sectional view of a carburetor having low speed and high speed fuel flow control (e.g. needle) valves.

FIG. 2 illustrates an implementation of a carburetor that is similar in construction as the carburetor shown in FIG. 1. Similar components will be given the same reference numerals and will not be discussed in detail again.

In this implementation, the carburetor includes a high speed fuel adjustment needle valve 60 as well as a low speed needle valve 61, and the needle valves may be similar to the valve 19 previously discussed. In this implementation, the high speed nozzle 21 is not downstream of the low speed needle valve 61; only the low speed ports 38 are. The high speed nozzle 21 is downstream of the high speed needle valve 60. To route fuel to both the high speed nozzle 21 and low speed ports 38, the first fuel passage 16*a* leads to a second fuel passage that branches to include both a low speed fuel passage 62 and a high speed fuel passage 63. The low speed fuel passage 62 communicates with the first fuel passage 16*a* and the metering chamber 11 downstream of the check valve 17, and leads to the low speed ports 38 through the low speed needle valve 61. The high speed fuel passage 63 communicates with the first fuel passage 16*a* and the metering chamber 11 downstream of the check valve 17, and leads to the high speed nozzle 21 through the high speed needle valve 60. As in the prior embodiment, the first fuel passage 16*a* also communicates the fuel reservoir chamber 18*a* with the fuel metering chamber 11 through the check valve 17. As noted above, a check valve 22 is provided at the high speed nozzle 21. The check valve 22 may have an identical structure as the check valve 17, or any other suitable structure.

As in the embodiment of FIG. 1, upon closing the throttle valve 3, the piston 23 is moved in a direction that enlarges the volume of the fuel reservoir chamber 18*a* which refills with liquid fuel, and that fuel may be drawn directly from the fuel metering chamber without the fuel having to flow past one of the needle valves prior to entering the fuel reservoir chamber. Air is substantially or completely prevented from being drawn into the fuel reservoir chamber 18*a* as in the previously described embodiment, such as by the routing of the fuel passages 62, 63, the needle valves 60, 61 provided between the ports 21, 38 and the first fuel passage 16*a* and reservoir chamber 18*a*, and the check valve 22 at the high speed nozzle 21.

Figure 3:
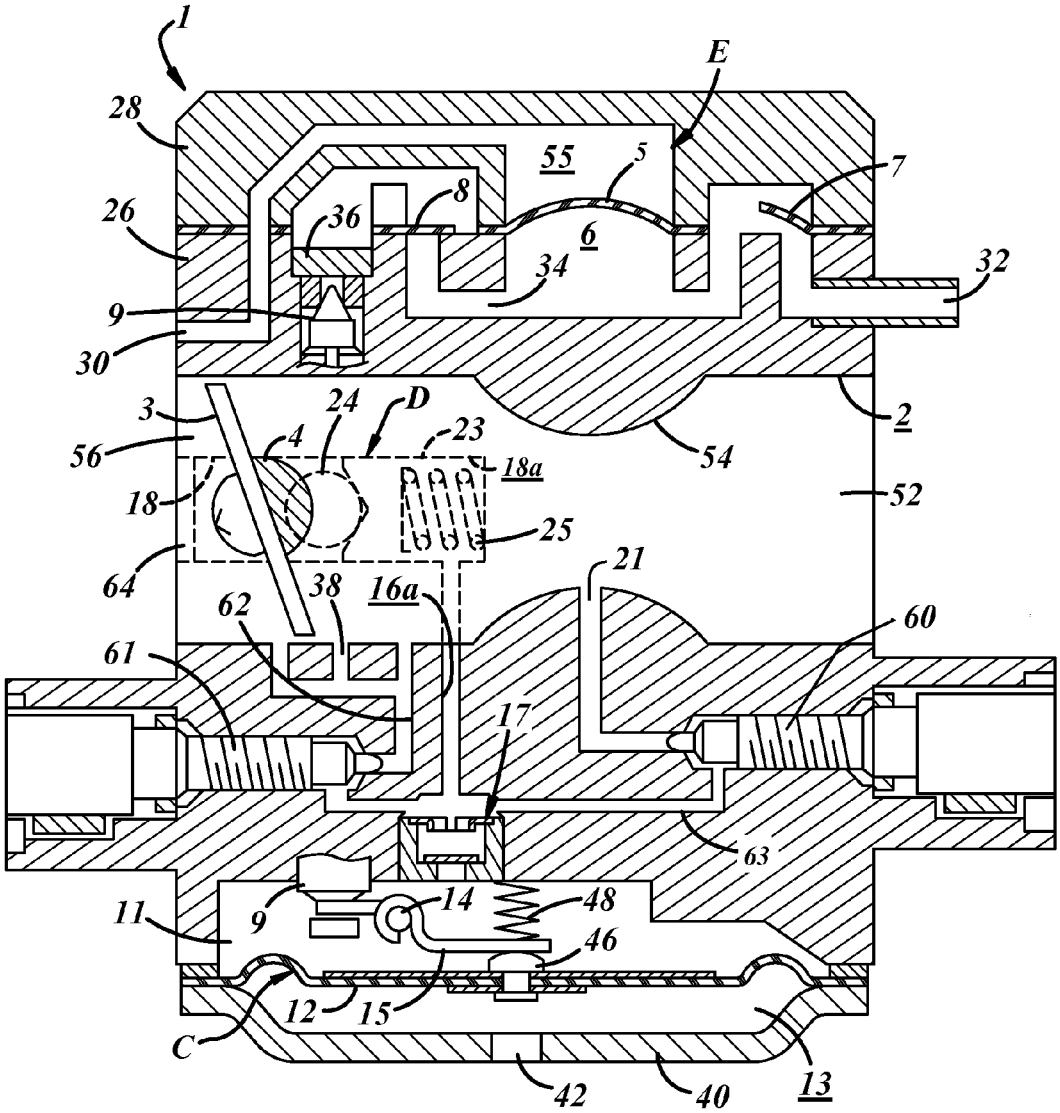
FIG. 3 is a sectional view of a carburetor like that shown in FIG. 2 and having a high speed port without an outlet check valve.

FIG. 3 illustrates a carburetor like that shown in FIG. 2 except no check valve 22 is provided at the high speed nozzle 21. The remainder of the carburetor may be the same and hence, will not be described further. The intake of air into the reservoir chamber is still substantially inhibited or prevented as described above.

Figure 4:
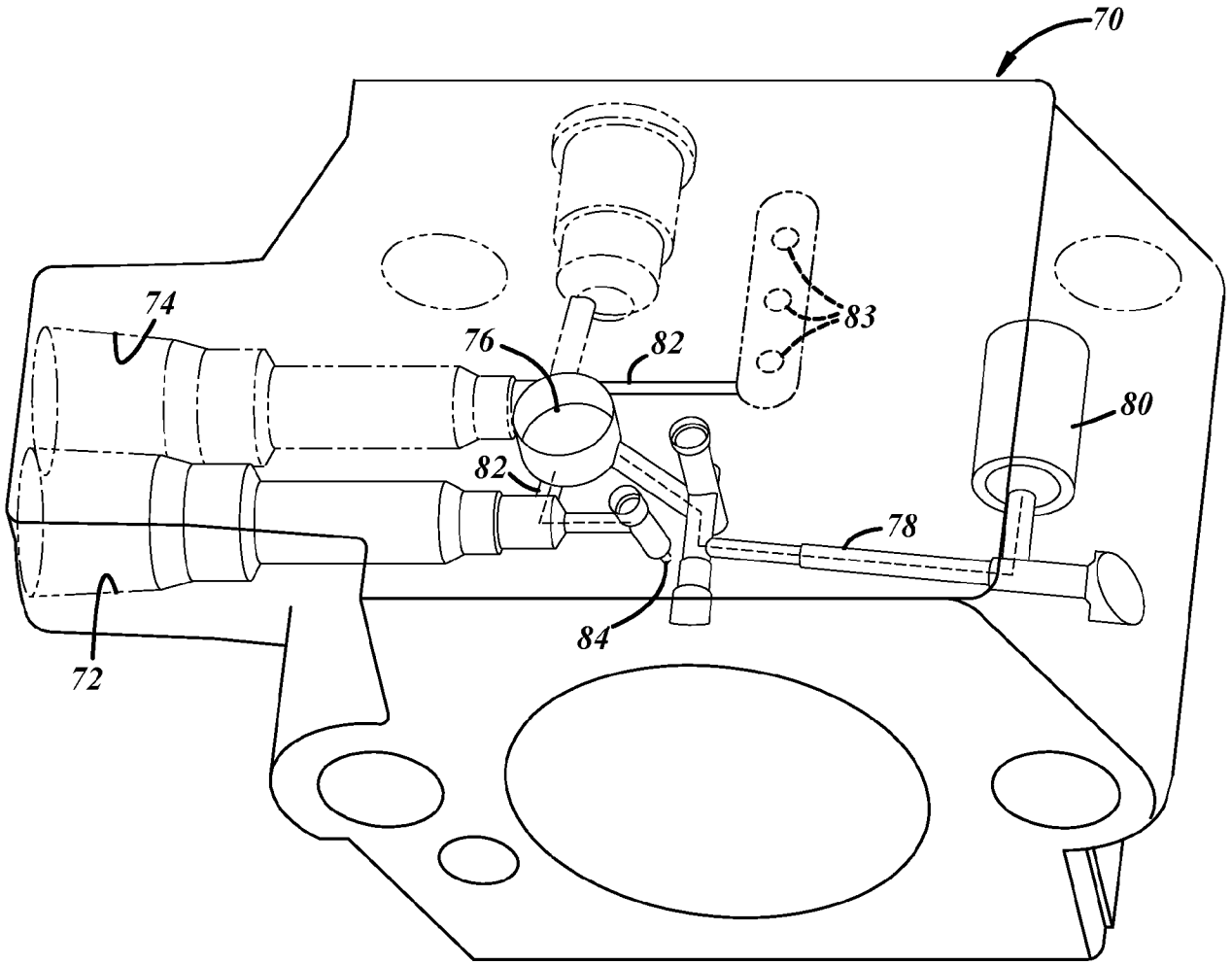
FIG. 4 is a perspective view of a carburetor body showing an accelerator fuel circuit according to one implementation.

FIG. 4 illustrates a main body 70 of a carburetor according to one implementation. The body may include a cavity 72 adapted to receive a high speed fuel flow control valve, and a cavity 74 adapted to receive a low speed fuel flow control valve. The high and low speed fuel control valves may be constructed as shown in FIGS. 1-3, or in any other suitable manner. A pocket 76 in the main body 70 may receive a check valve between the fuel metering assembly and a first fuel passage 78. The check valve may be constructed as set forth with regard to check valve 17 described earlier. The first fuel passage 78 leads to a reservoir chamber 80 of the accelerator device D, and extends between the check valve (the pocket 76 of which is shown) and the reservoir chamber 80. The pocket 76 may also lead to a second fuel passage 82 which may include one or more passages that lead to the low speed ports 83 and the high speed nozzle 84. The low and high speed fuel flow control valves control fuel flow between the check valve pocket 76 (and hence, a check valve within the pocket) and the low speed ports and the high speed nozzle 84. Further, the reservoir chamber 80 communicates directly with the check valve pocket 76 via the first fuel passage 78. A carburetor including the main body 70 as constructed in FIG. 4, may function and be operated in the manner previously described with regard to FIGS. 1-3. Accordingly, the further construction and operation of such a carburetor will not be further described.

In the embodiments shown in the figures, the accelerator pump arrangement includes a piston slideably received in a cylinder or chamber to move fuel into and out of the chamber. In other embodiments, the pump arrangement is not limited by such a cylinder/piston pump, but may consist of any pump as long as it is capable of achieving a pump action at a desired time or times, which in at least some implementations is in synchronism with the rotation of the valve shaft 4. Likewise, the throttle valve is shown as a butterfly type-throttle valve but other construction and arrangements may be used. Still other modifications and alternatives are possible and contemplated to be within the scope of the following claims.

The invention claimed is:

1. A carburetor, comprising:

an intake bore including a port opening into the intake bore;

a fuel chamber from which fuel is supplied within the carburetor to the intake bore through the port;

an accelerator device for increasing an amount of fuel supplied to the port under at least certain operating conditions and including a fuel reservoir constructed and arranged to store fuel;

a fuel flow control valve between the fuel chamber and the port to control the flow rate of fuel to the port; and at least one passage communicating the fuel reservoir with the port and through which fuel in the fuel reservoir is supplied to the port, said at least one passage also communicating the fuel reservoir with the fuel chamber, wherein the fuel flow control valve is located between the fuel reservoir and the port and between the fuel chamber and the port, and said at least one passage includes a portion extending between the fuel reservoir and the fuel chamber independently of the fuel flow control valve.

2. The carburetor according to claim 1 which includes a check valve between the fuel flow control valve and the port to permit fluid flow out of the port and into the intake bore and inhibit or prevent fluid flow from the intake bore through the port.

3. The carburetor according to claim 1 which includes a check valve between the fuel chamber and the fuel reservoir to permit fluid flow out of the fuel chamber toward the fuel reservoir and inhibit or prevent fluid flow in the opposite direction.

4. The carburetor according to claim 3 wherein said at least one passage communicating the fuel reservoir with the port includes a first portion that leads from the check valve to the port, and a second portion that interconnects the fuel reservoir and fuel chamber when the check valve is open.

5. The carburetor according to claim 4 wherein fuel flow control valve is provided in the first portion.

6. The carburetor according to claim 1 which also includes a second port opening into the intake bore and through which fuel is supplied into the intake bore and a second fuel flow control valve that is located between the fuel reservoir and the second port and between the fuel chamber and the second port, and wherein said at least one passage includes a first fuel passage that leads to a second fuel passage that branches to communicate with the second port through the second flow control valve and with the other port through the other fuel flow control valve, and fuel may flow from the fuel chamber to the fuel reservoir through the first fuel passage without having to flow through either fuel flow control valve.

7. A carburetor, comprising:

an intake bore including a low speed port opening into the intake bore and a high speed port opening into the intake bore;

a fuel chamber from which fuel is supplied within the carburetor to the intake bore through both of the low speed port and the high speed port;

an accelerator device for increasing an amount of fuel supplied to the intake bore through one or both of the low speed port and the high speed port under at least certain operating conditions and including a fuel reservoir constructed and arranged to store fuel;

at least one fuel flow control valve located between the fuel chamber and both the low speed port and the high speed port to control the flow rate of fuel to the low speed port and the high speed port; and at least one passage communicating the fuel reservoir with both the low speed port and the high speed port and through which fuel in the fuel reservoir is supplied to the ports, said at least one passage also communicating the fuel reservoir with the fuel chamber, wherein said at least one fuel flow control valve is located between the fuel reservoir and both the high speed port and the low speed port, and between the fuel chamber and both the low speed port and the high speed port, and said at least one passage includes a portion extending between the fuel reservoir and the fuel chamber independently of said at least one fuel flow control valve.

8. The carburetor according to claim 7 wherein said at least one fuel flow control valve includes a low speed fuel flow control valve located between the fuel reservoir and the low speed port and between the fuel chamber and the low speed port, and a high speed fuel flow control valve located between the fuel reservoir and the high speed port and between the fuel chamber and the high speed port.

9. The carburetor according to claim 8 wherein fuel may flow from the fuel reservoir or the fuel chamber to the high speed port without flowing through the low speed fuel flow control valve.

10. The carburetor according to claim 8 wherein fuel may flow from the fuel reservoir or the fuel chamber to the low speed port without flowing through the high speed fuel flow control valve.

11. The carburetor according to claim 7 which also includes a check valve located between the fuel chamber and the fuel reservoir.

12. The carburetor according to claim 7 which also includes a check valve between the fuel flow control valve and the port to permit fluid flow out of the port and into the intake bore and inhibit or prevent fluid flow from the intake bore through the port.

* * * * *